US005148562A

United States Patent [19]

Borders et al.

[11] Patent Number: 5,148,562

[45] Date of Patent: Sep. 22, 1992

[54] BIRTHING BED ADJUSTABLE TO TRENDELENBURG POSITION

[75] Inventors: Richard L. Borders, Cincinnati, Ohio; Daniel G. Stafford, Batesville, Ind.; Sandy M. Richards, Centerville, Ind.; Allen L. Walke, Batesville, Ind.

[73] Assignee: Hill-Rom Company, Inc., Batesville, Ind.

[21] Appl. No.: 779,907

[22] Filed: Oct. 21, 1991

[51] Int. Cl.[5] ..... A61G 7/00

[52] U.S. Cl. ..... 5/610; 5/611; 5/602

[58] Field of Search ..... 5/62–64, 5/602; 269/323

[56] References Cited

U.S. PATENT DOCUMENTS

| | | | |
|---|---|---|---|
| 3,336,606 | 8/1967 | Beitzel | 5/63 X |
| 3,492,679 | 2/1970 | Drew . | |
| 3,711,876 | 1/1973 | Kirkland et al. . | |
| 3,733,623 | 5/1973 | Croxton | 5/62 X |
| 3,958,283 | 5/1976 | Adams et al. . | |
| 4,025,972 | 5/1977 | Adams et al. . | |
| 4,097,939 | 7/1978 | Peck et al. . | |
| 4,139,917 | 2/1979 | Fenwick . | |
| 4,411,035 | 10/1983 | Fenwick . | |
| 4,639,954 | 2/1987 | Speed | 5/63 |
| 4,860,394 | 8/1989 | Benessis et al. | 5/62 |
| 4,894,876 | 1/1990 | Fenwick . | |

FOREIGN PATENT DOCUMENTS

| | | | |
|---|---|---|---|
| 851402 | 9/1970 | Canada | 5/63 |
| 1198892 | 7/1970 | United Kingdom | 5/63 |
| 2095545 | 10/1982 | United Kingdom | 5/63 |

*Primary Examiner*—Michael F. Trettel
*Attorney, Agent, or Firm*—Wood, Herron & Evans

[57] ABSTRACT

A birthing bed has a base, an intermediate frame mounted on the base with a power-actuated linkage to raise and lower the intermediate frame with respect to the base. A main frame is pivotably mounted on the intermediate frame so that it can be shifted from a horizontal position to an inclined Trendelenburg position. The intermediate frame is adapted to be lowered to bring the patient support surface to a very low level. In that level, the bed can be shifted to a Trendelenburg position with limit switches causing the intermediate frame to rise in order to accommodate the shift of the main frame to the inclined Trendelenburg position.

9 Claims, 5 Drawing Sheets

BIRTHING BED ADJUSTABLE TO TRENDELENBURG POSITION

This invention relates to a hospital bed and more particularly to a birthing bed having a patient support surface that can be shifted to a Trendelenburg position.

A conventional birthing bed has a height to the top of the mattress of as low as 25 inches but can be raised to a height of up to 46 inches. A principal objective of the present invention has been to reduce the height of the bed to about 22 inches, the patient support panels being at a height of about 18 inches and the mattress being about 4 inches thick. This is an ideal height for a mother about to give birth, for it enables the mother to get in and out of the bed very easily as the mother will frequently wish to do during the laboring process.

It is important for the bed to have the capability of shifting to a Trendelenburg position, that is, a position in which the patient support surface is inclined with the head lowered below the foot end. The Trendelenburg position is important for the patient's well being when she is undergoing cardiac arrest. Further, the position is useful in slowing the birthing process if the baby is coming too fast.

The two features, low bed level and Trendelenburg position, are somewhat inconsistent in that when the support surface is at its lowest level, the floor of the hospital room creates an obstruction to the shifting of the support surface to the inclined Trendelenburg position at any height.

SUMMARY OF THE INVENTION

It has been an objective of the present invention to provide a birthing bed having a low patient support surface and having additionally the capability of shifting into a full Trendelenburg position.

This objective of the present invention is attained by providing a base, an intermediate frame mounted on the base with a power-operated parallelogram linkage connecting the base to the intermediate frame and permitting the intermediate frame to be raised and lowered. A main frame is mounted on the intermediate frame on a pivot axis approximately centered between the two ends of the bed. A valve-operated gas spring normally maintains the bed in its horizontal attitude but is adapted to be released to permit the main frame to be pivoted to the Trendelenburg position. The power system for raising the intermediate frame includes limit switches that are triggered by the combined positioning of the intermediate frame and the pivoting of the main frame to the Trendelenburg position so that when the bed is in its lowest position and the main frame begins to pivot to the Trendelenburg position, the power system for the intermediate frame will raise the intermediate frame in order to permit the bed to accommodate the shift to full Trendelenburg position.

Another feature of the invention is the provision of a notch in the intermediate frame that permits the intermediate frame and with it the patient support surface to be lowered to the 22 inch level.

Another feature of the invention is the provision of a depending bar mounted on the main frame having a wheel at its lower end to provide a rolling engagement of the main frame with the floor when the bed is shifted to the Trendelenburg position.

Another objective of the present invention has been to provide improved hand controls for pivoting the main frame into and out of the Trendelenburg position. This objective of the present invention has been attained by providing a main frame pivoted approximately at its center and supported at one end by a pneumatic spring having a valve in its piston. A handle is mounted on each side of the main frame and connected to a common axle. The axle has a valve-operating mechanism connected to it so as to open the valve in the gas spring when the handle is pushed downwardly to move the main frame to the Trendelenburg position and when the handle is pulled upwardly to raise the main frame to the normal horizontal position.

Another feature of the invention has been to provide a footrest having a parallelogram linkage mounting it to the intermediate frame and a foot end drive that is pivoted off the same pivot bar that mounts the main frame to the intermediate frame.

BRIEF DESCRIPTION OF THE DRAWINGS

The several features and objectives of the present invention will become more readily apparent by referring to the accompanying drawings in which.

DETAILED DESCRIPTION OF THE INVENTION

Figure 1:
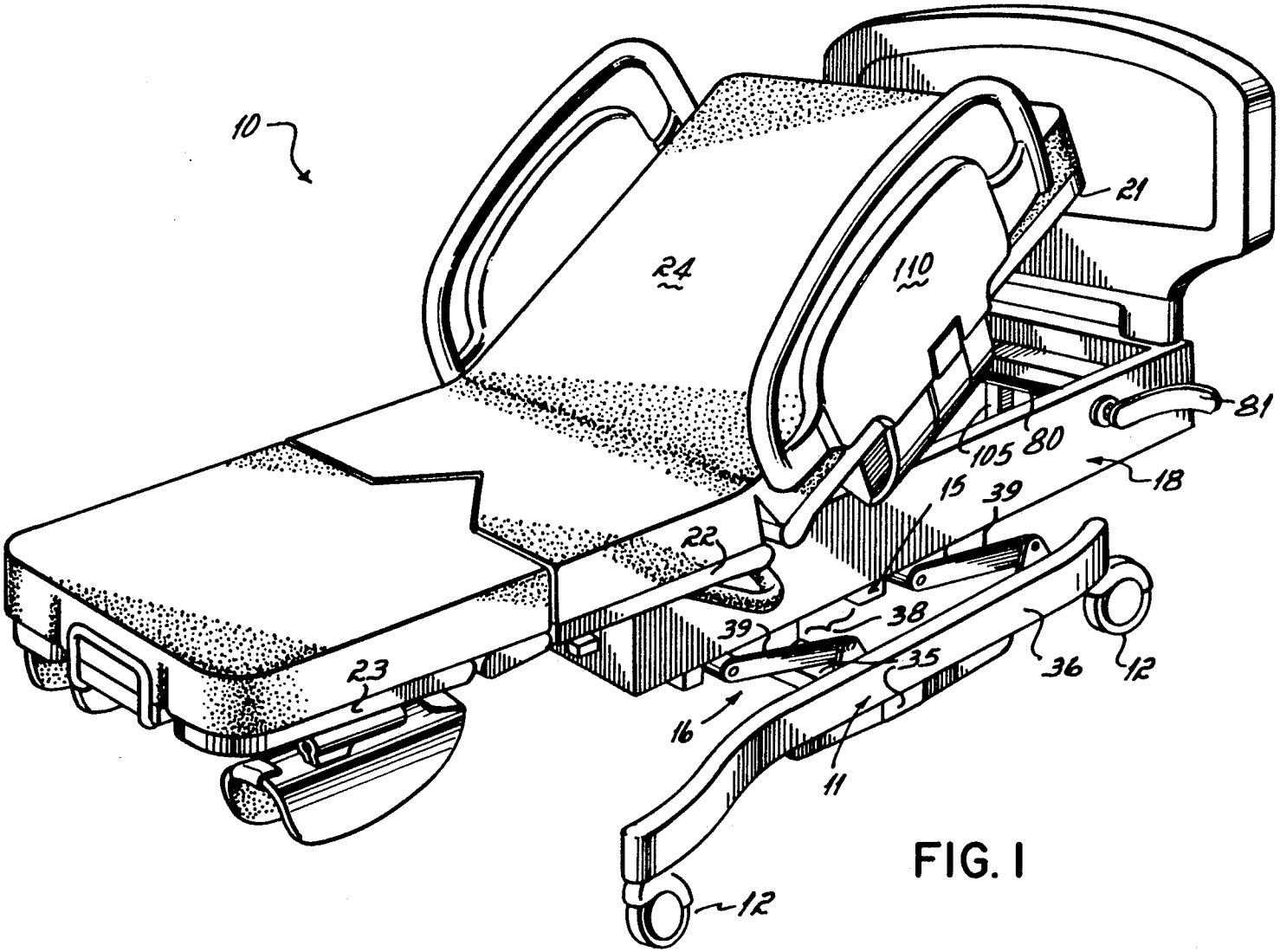
FIG. 1 is a perspective view of a birthing bed employing the present invention.
Figure 2:
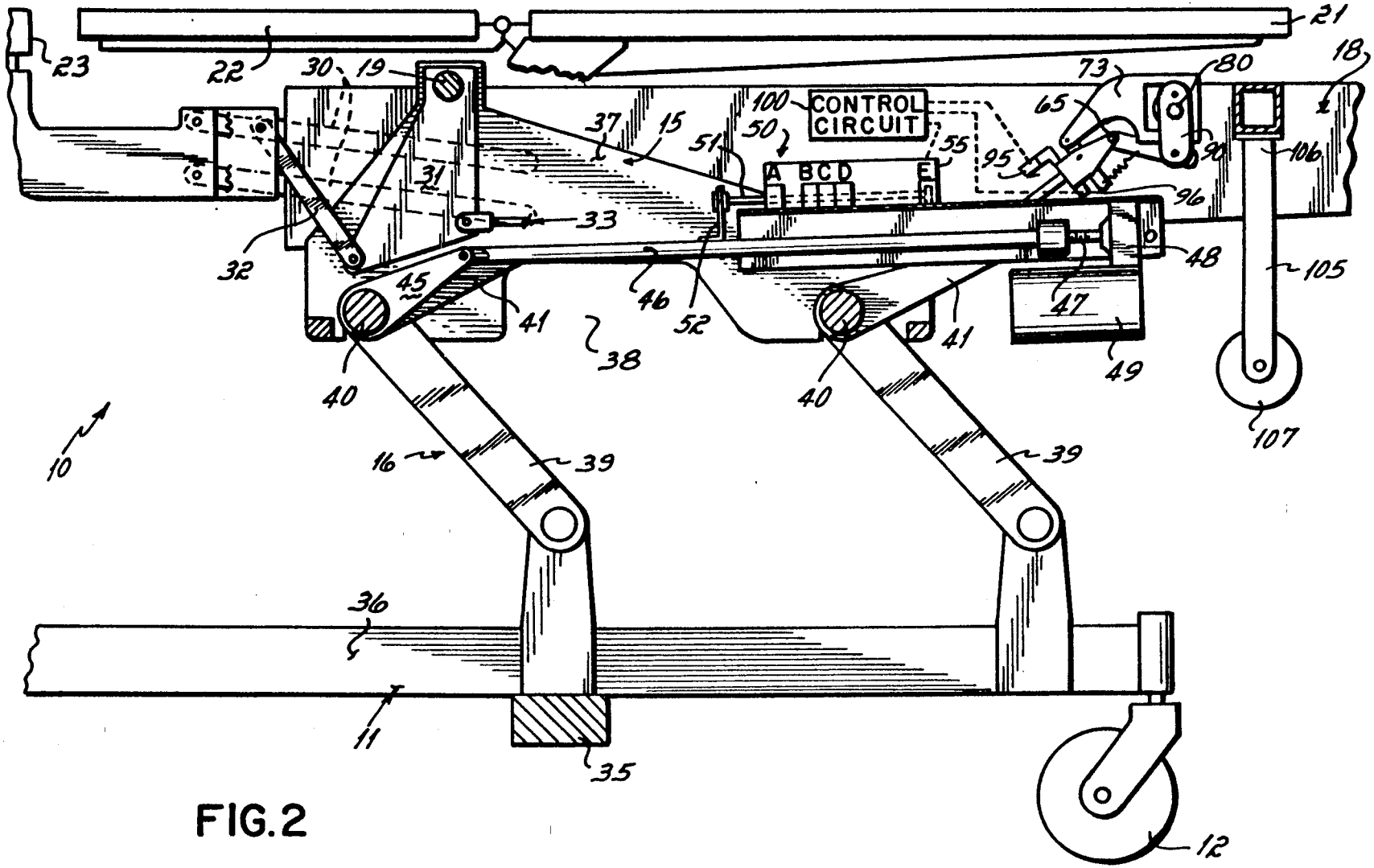
FIG. 2 is a fragmentary side elevational view, partly in section, of the birthing bed of the present invention.

A hospital bed and specifically a birthing bed 10 is shown in FIGS. 1 and 2. It has a base 11 with casters 12 providing a rolling support. An intermediate frame 15 is supported on the base 11 by a parallelogram linkage 16. A main frame 18 has a pivot shaft 19 connecting it to the intermediate frame 15. A gas spring 20 connects the head end of the main frame to the intermediate frame and normally maintains the main frame in a horizontal attitude.

Figures 3, 3A, 3B:
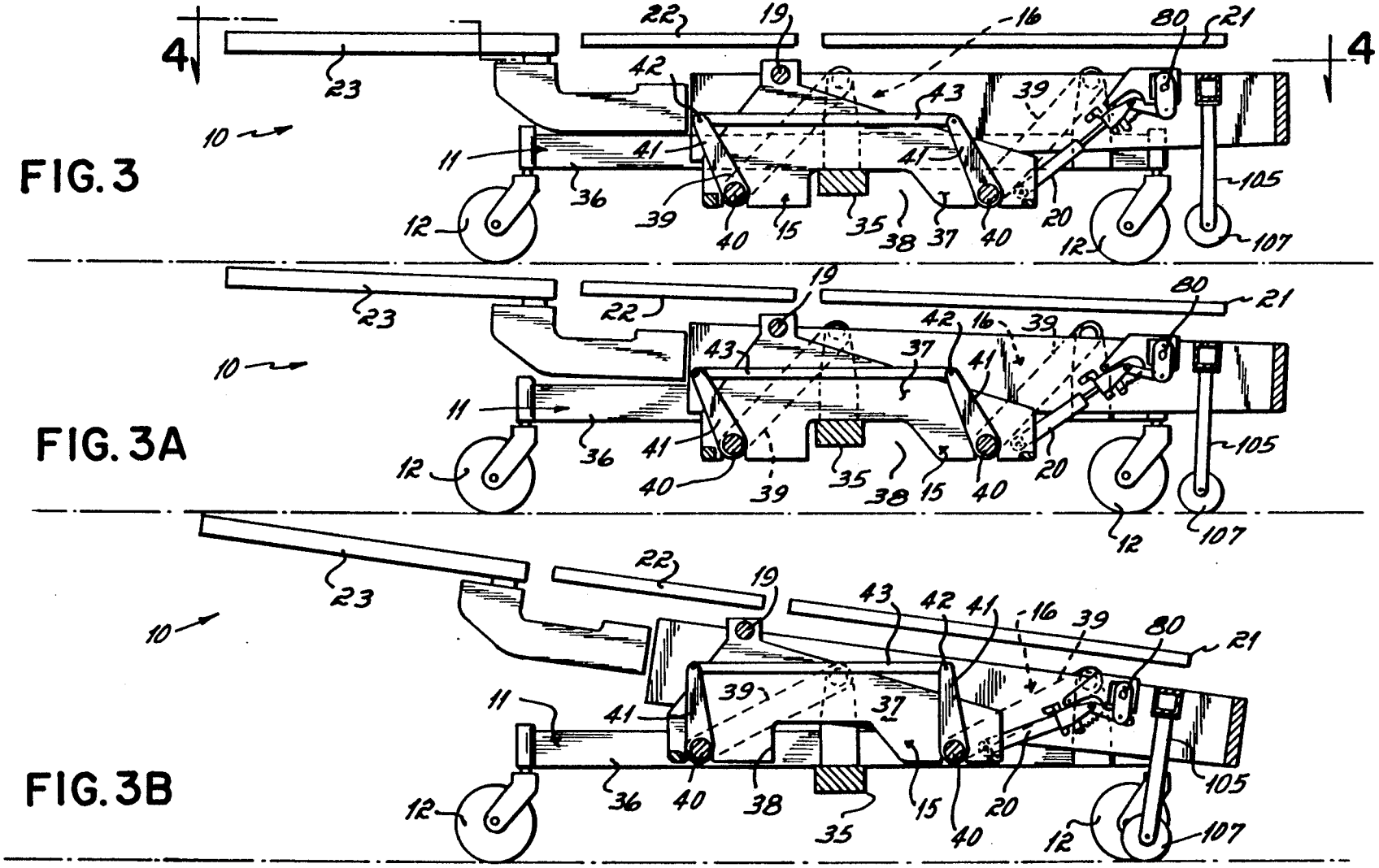
FIG. 3 is a side elevational view similar to FIG. 2 with some detail omitted showing the bed at its lowered position.
FIG. 3A is a side elevational view similar to FIG. 3 showing the bed partially changed to a Trendelenburg position.
FIG. 3B is a side elevational view similar to FIG. 1 showing the bed in full Trendelenburg position.
Figure 4:
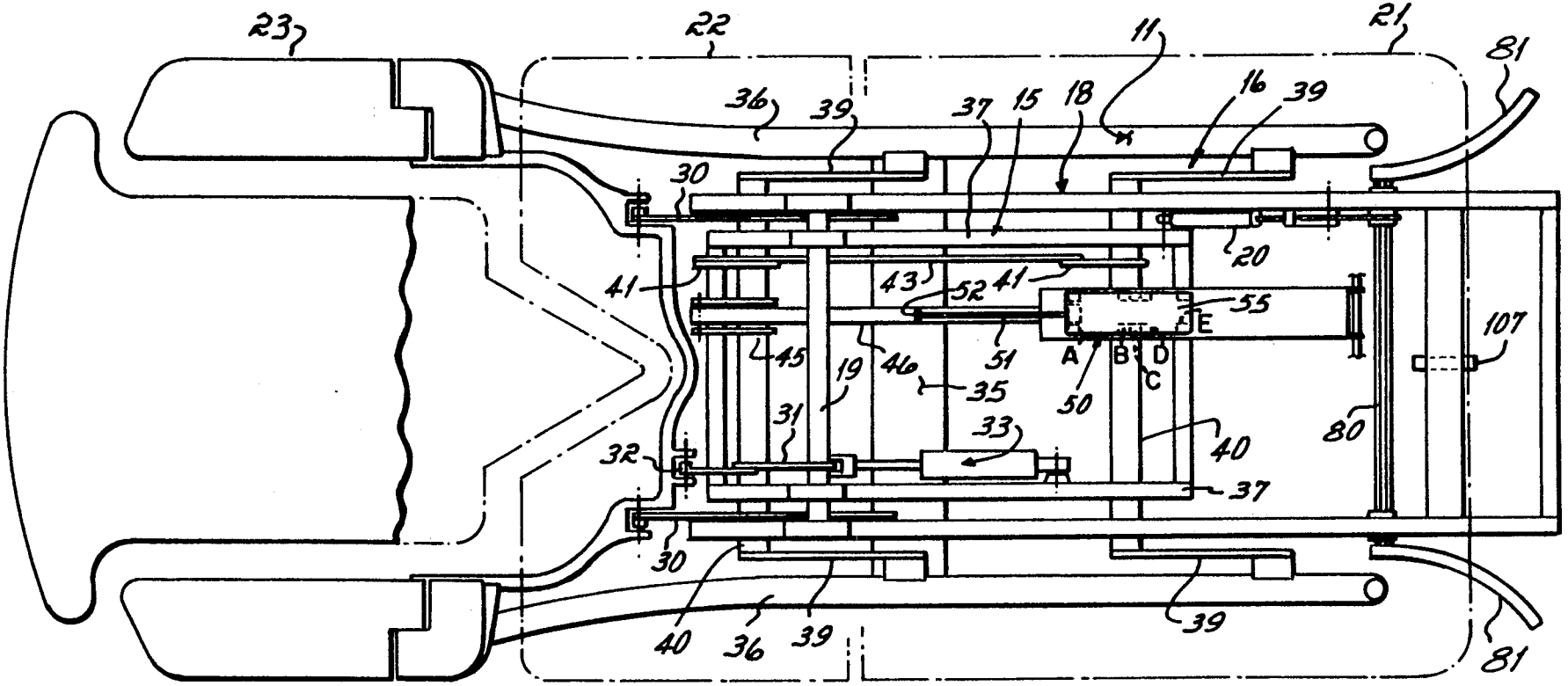
FIG. 4 is a top plan view of the bed with the patient support panels and some other mechanism removed for clarity.

A head panel 21, a seat panel 22 and a footrest 23 are mounted on the main frame 18 and form a deck that is about 18 inches above ground level when the main frame is in its lowermost position (FIG. 3). A four inch thick mattress 24 covers the panels 21, 22 and 23. The head panel 21 is on the main frame so that it can be pivoted into an upwardly inclined position, as shown in FIG. 1. The footrest is mounted by a parallelogram linkage 30 to the intermediate frame (FIG. 2). A bellcrank lever 31 pivoted on the main frame pivot shaft 19 is connected by a drive link 32 to the footrest. The bellcrank lever is also connected to a piston and cylinder 33 adapted to raise and lower the footrest 23.

The base has a transverse beam 35 interconnecting longitudinal rails 36. The beam 35 is a primary structural element tying the longitudinal rails 36 together to form the base. The intermediate frame 15 has a pair of spaced, longitudinal members 37 which are notched at 38 to provide a recess that receives the transverse beam 35 when the intermediate frame is in its lowermost position, as depicted in FIGS. 3 and 3A.

Each link 39 in the parallelogram linkage 16 is connected at its upper end to a shaft 40. Each shaft 40 is journalled in the intermediate frame 15. Each shaft 40 has a lever 41 fixed to it. The two levers 41 are pivoted at 42 to a longitudinal rod 43 that causes the shafts 40 to rotate together. One of the shafts 40 has a lever 45 fixed to it. The lever 45 is fixed to an internally-threaded tube 46, the threaded tube being threaded onto the screw 47 of a ball-screw driver connected via a gear box 48 to a motor 49. Rotation of the motor in one direction rotates the screw 47, driving tube 46 linearly to cause the lever 45 to rotate, thereby causing the parallelogram linkage 16 to swing downwardly. Rotation of the motor 48 in the opposite direction causes the parallelogram linkage 16 to swing upwardly to its maximum height as depicted in FIG. 2.

An optical position sensor 50 has a rod 51 fixed by a bracket 52 to the tube 46. The rod 51 projects into an optical position sensor box 55 having multiple positions A, B, C, D and E. Each position has a light source beaming across the box to a photocell. When the rod end crosses any of the positions A–E, the light is blocked, thereby indicating the position of the rod within the box 55, but more particularly, the vertical position of the intermediate frame 15 with respect to the base 11.

Figure 5:
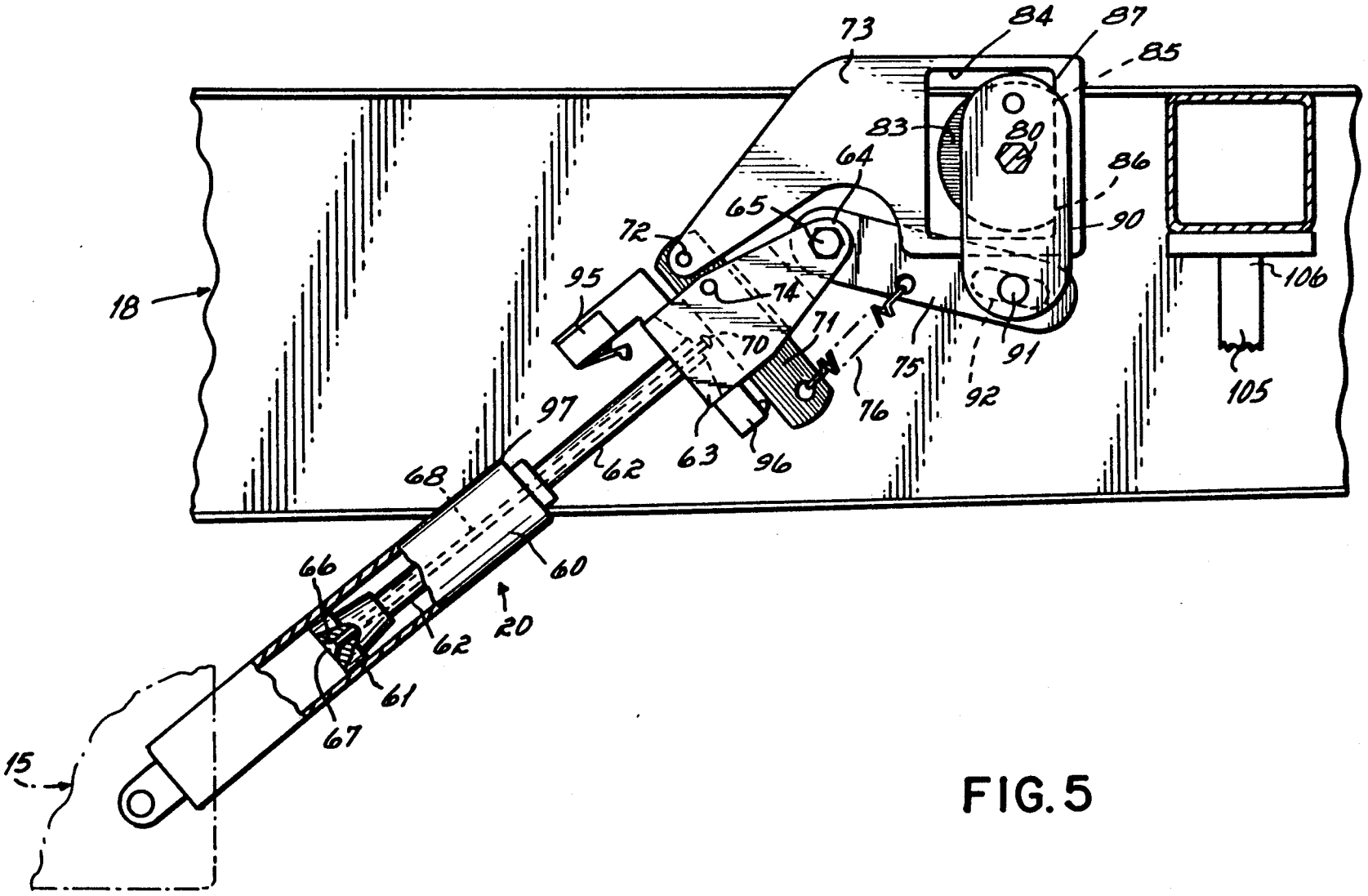
FIG. 5 is a side elevational view partly in section illustrating the pneumatic spring and Trendelenburg operating mechanism.

The pneumatic spring 20 normally maintains the main frame 18 in horizontal attitude with respect to the intermediate frame 15. The mechanism for contracting the pneumatic spring 20 and shifting to a Trendelenburg position wherein the head end of the bed is lowered below the foot end is best illustrated in FIG. 5 taken in conjunction with FIGS. 3–3B.

The pneumatic spring 20 has a cylinder 60 within which a piston 61 slides. The piston 61 is mounted on a rod 62. The rod 62 is threaded onto a gas head 63 whose end 64 is anchored to the main frame by a pivot bolt 65. The piston rod is hollow and has a valve seat 66 at its inner end. A valve 67 is mounted on the seat and is connected by a rod 68 loosely slidable in the piston rod 62. The rod 68 has a head 70 which, when pressed, will cause the valve 67 to move off its seat 66 and permit air to flow from one side of the piston to the other as is conventional with gas springs. See, for example, the BLOC-0-LIFT TM gas spring manufactured by Gas Spring Company of Colmar, Pa.

A valve operation lever 71 is pivoted at 72 to a follower 73. The lever 71 is also connected by a pivot pin 74 to the gas head 63. A stop lever 75 is pivoted to the bolt 65 and is connected by a tension spring 76 to the lever 71. Tension spring 76 holds the lever 71 away from the rod head 70.

A hexagonal shaft 80 extends transversely across the main frame 18. It is connected to operating levers or handles 81 on each side of the main frame. When either operating lever is pulled upwardly, the main frame can be pivoted upwardly. When either operating lever is pushed downwardly, the main frame will pivot downwardly into the Trendelenburg position. The shaft 80 is fixed to a cam 83. Cam 83 is disposed within a rectangular opening 84 in the follower 73. The cam 83 has an upper surface 85 and a lower surface 86, each of which is engageable with a vertical surface 87 on the follower. If the cam is rotated either clockwise or counterclockwise, a respective cam surface will push the follower toward the right as viewed in FIG. 5. That movement will pivot the valve operator lever 71 and cause it to contact head 70 to push the valve rod 68 inwardly, thereby permitting gas to flow around valve 67 from one side to the other of the piston 61 and thereby permitting the main frame to pivot up or down with respect to the intermediate frame.

Two depending levers 90 are mounted on the shaft 80, one on each side of the Trendelenburg stop lever 75. A stop pin 91 is mounted on the depending lever 90 and rides in a slot 92 in the Trendelenburg stop lever. The pin and slot limits the pivoting movement of the shaft 80 and hence the swinging movement of the operating levers 81.

A position-sensing limit switch 95 is mounted on the gas head 63 and is engageable by edge 97 of the cylinder 60 of the gas spring 20 to close a circuit when the main frame has pivoted a predetermined distance toward the Trendelenburg position (FIG. 3A). A circuit-actuating limit switch 96 is also mounted to the gas head 63 and is positioned to be closed by valve lever 71 when the handle 81 is rotated to lower the head end into a Trendelenburg attitude. When the handle 81 is released, the circuit is interrupted. A control circuit 100 is connected to the limit switch 95 and is connected to the photoelectric cells A, B, C, D and E in the control box 55 to control the operation of the bed.

A depending strut 105 has its upper end 106 fixed centrally to the head end of the main frame and has a floor-engaging wheel 107 at its lower end. The wheel and strut limit the downward swinging of the main frame when the main frame and intermediate frame are in the lower position with respect to the base, as depicted in FIGS. 3–3B.

In the operation of the invention, a control panel 110 (FIG. 1), connected to the control circuit 100 is operated to lower the intermediate frame to its lowermost position depicted in FIG. 3. When it is desired to go to the Trendelenburg position, either lever 81 is depressed to physically push the main frame to pivot it about its transverse pivot shaft 19. The pushing on the lever 81 rotates the hexagonal shaft 80, thereby swinging the follower 73 to the right as depicted in FIG. 5. That in turns swings the lever 71 about its pivot point 74 and opens the valve in gas spring 20 while simultaneously closing switch 96. Switch 96 energizes the circuit 100 to raise the bed as the head end is lowered. Raising will continue until sensor B is blocked. The resistance to the downward swinging movement of the head end of the main frame with respect to the intermediate frame is relieved by the activation of the gas spring and the nurse can lower the main frame.

In this lowermost position, the intermediate frame will permit only the limited Trendelenburg position (FIG. 3A) and will not permit the main frame to go into a full Trendelenburg position (FIG. 3B). Just as the wheel 107 of the strut 105 engages the ground, the limit switch 95 is closed. Since the optical switch B is also closed, indicating that the intermediate frame needs to be raised, the control circuit will energize the motor 48 to cause the intermediate frame to rise. While the intermediate frame is rising, the nurse is pushing down on the main frame by pushing down on the lever 81. This keeps the wheel 107 of the strut 105 in engagement with the floor and it rolls along the floor as depicted by comparing FIGS. 3A to 3B. The rolling on the floor takes place simultaneously with the rising of the intermediate frame until the full Trendelenburg position is achieved, as depicted in FIG. 3B. At that point, the rod 51 closes photocell C on the box 55, indicating that a sufficient height of the intermediate frame has been achieved to permit the full Trendelenburg position. The motor 48 is then deenergized.

To return the main frame to a horizontal position, a handle 81, on either side of the bed, is lifted. As explained above, that will open the valve in the gas spring and permit the head end of the main frame to be raised.

From the foregoing, it can be seen that the main frame can be pivoted in either direction by a nurse operating a handle 81 on either side of the bed.

Further, if the bed is without power to raise the intermediate frame, the main frame can be pivoted to a partial Trendelenburg position as limited by the strut 105 and wheel 107 engaging the floor.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. A hospital bed comprising:

a base, an intermediate frame, a linkage mounting said intermediate frame on said base, power means for raising and lowering said intermediate frame with respect to said base, a main frame having a foot end and a head end, said main frame being pivotally mounted to said intermediate frame on a transverse axis, means for pivoting the head end of said main frame below said foot end to achieve a Trendelenburg position, and control means for operating said power means during pivoting of said main frame to the Trendelenburg position when said intermediate frame is in its lowermost position to raise said intermediate frame to permit full pivoting of said main frame.

2. A hospital bed as in claim 1 further comprising patient support panels forming a deck on said main frame, said deck being about 18 inches above a floor supporting said bed when said intermediate frame is in its lowermost position.

3. A hospital bed as in claim 2 further comprising:

a transverse brace forming part of said base, said intermediate frame having a downwardly-facing notch that receives said brace when said intermediate frame is in its lowermost position.

4. A hospital bed as in claim 1 further comprising:

a strut projecting downwardly from the head end of said main frame, at least one auxiliary wheel mounted on said strut, said wheel being engageable with the floor supporting said bed when said main frame is pivoted to Trendelenburg position and said intermediate frame has been moved to its lowermost position, thereby swinging said main frame forward as said wheel rolls on the floor to prevent the main frame crashing against the floor.

5. A hospital bed as in claim 1 in which said transverse axis for said main frame is located in the central portion of said bed, said bed further comprising a gas spring mounted between the head end portion of said main frame and said intermediate frame to support the head end of said main frame.

6. A hospital bed as in claim 5 further comprising:

a handle on each side of said bed, means connecting each handle to a valve within said gas spring to permit said gas spring to collapse when either of said handles is actuated, thereby permitting a quick shift to Trendelenburg position by an attendant positioned at either side of said bed.

7. A hospital bed as in claim 6 further comprising:

a transverse shaft rotatably mounted across said main frame, said handles being fixed to said shaft, a cam mounted on said shaft, a follower mounted on said main frame, means connecting said follower to said valve within said gas spring, the surface of said cam causing a valve-operating thrust of said follower when said shaft is rotated in one direction by pulling on said handles and in the opposite direction by pushing on said handle.

8. A hospital bed comprising:

a base, an elongated main frame, means connecting said main frame to said base on a transverse pivotal axis located centrally of said main frame, a gas spring connected to said main frame to support said main frame in a horizontal position, a valve in said gas spring operable to release said spring to permit said main frame to pivot, a handle on each side of said main frame at one end thereof, means pivotally mounting said handles to pivot up and down and to operate said valve when pivoted in either direction, whereby said one end of said main frame can be raised or lowered from either side of said bed by an operator using one hand.

9. A hospital bed as in claim 8 further comprising:

a transverse shaft rotatably mounted across said main frame, said handles being fixed to said shaft, a cam mounted on said shaft, a follower mounted on said main frame, means connecting said follower to said valve within said gas spring, the surface of said cam causing a valve-operating thrust of said follower when said shaft is rotated in one direction by pulling on said handles and in the opposite direction by pushing on said handle.

* * * * *